US011964789B2

(12) United States Patent
Malone

(10) Patent No.: US 11,964,789 B2
(45) Date of Patent: Apr. 23, 2024

(54) METHOD AND APPARATUS FOR SECURED PACKING OF OBJECTS

(71) Applicant: Diamond 6S Management, San Antonio, TX (US)

(72) Inventor: Dale Malone, Austin, TX (US)

(73) Assignee: Diamond 6S Management, San Antonio, TX (US)

( * ) Notice: Subject to any disclaimer, the term of this patent is extended or adjusted under 35 U.S.C. 154(b) by 851 days.

(21) Appl. No.: 15/333,975

(22) Filed: Oct. 25, 2016

(65) Prior Publication Data

US 2017/0113862 A1 Apr. 27, 2017

Related U.S. Application Data

(60) Provisional application No. 62/247,110, filed on Oct. 27, 2015.

(51) Int. Cl.

| | |
|---|---|
| ***B65D 81/05*** | (2006.01) |
| ***B65B 5/04*** | (2006.01) |
| ***B65B 61/20*** | (2006.01) |
| ***B65D 81/107*** | (2006.01) |

(52) U.S. Cl.

CPC ..... *B65B 61/20* (2013.01); *B65B 5/04* (2013.01); *B65D 81/057* (2013.01); *B65D 81/1075* (2013.01); *B65D 2581/055* (2013.01)

(58) Field of Classification Search

CPC . B65B 61/20; B65B 5/04; B65D 81/053–058; B65D 81/1075; B65D 5/509

USPC ..... 206/588, 523, 586, 453

See application file for complete search history.

(56) References Cited

U.S. PATENT DOCUMENTS

| | | | | |
|---|---|---|---|---|
| 1,516,721 | A | 11/1924 | Emery | |
| 2,066,420 | A | 1/1937 | Reysa | |
| D202,691 | S | 11/1965 | Essman | |
| 3,334,798 | A | 8/1967 | Pezely, Jr. | |
| 3,439,860 | A | 4/1969 | Wienecke, Jr. | |
| 3,530,213 | A * | 9/1970 | Belle Isle | B29C 44/56 264/296 |
| 3,564,811 | A * | 2/1971 | Freeman | B65D 81/113 53/472 |
| 3,854,650 | A | 12/1974 | Hanaue | |
| 4,157,758 | A | 6/1979 | Kozlowski, Jr. | |
| 4,413,735 | A | 11/1983 | Little | |
| 4,422,546 | A | 12/1983 | Charity | |
| 4,784,269 | A | 11/1988 | Griffith | |
| 4,899,888 | A * | 2/1990 | Shawler | B65D 5/5033 206/453 |
| 4,947,500 | A | 8/1990 | Seiler | |
| D357,595 | S | 4/1995 | Roschacher | |
| 5,729,942 | A | 3/1998 | Moore, Jr. | |
| D397,270 | S | 8/1998 | Maalouf | |
| D455,074 | S | 4/2002 | Au | |

(Continued)

*Primary Examiner* — Mollie Impink

(74) *Attorney, Agent, or Firm* — Henry Patent Law Firm PLLC

(57) ABSTRACT

A packaging block that includes a body section having a aperture defined therein. A hinge defines a first portion of the body section and a second portion of the body section. The first portion is rotatably coupled to the second portion via the hinge. A plurality of selectively removable sections are removably coupled to the body section. The aperture receives at least a portion of an article to facilitate securement of the article during packaging and transport.

13 Claims, 10 Drawing Sheets

(56) References Cited

U.S. PATENT DOCUMENTS

| | | | | |
|---|---|---|---|---|
| D455,266 | S | 4/2002 | Bradford | |
| D460,263 | S | 7/2002 | Bradford | |
| 6,493,888 | B1 | 12/2002 | Salvatini et al. | |
| 6,981,589 | B2 * | 1/2006 | Sanders, Jr. | B65D 5/22 206/592 |
| D564,880 | S | 3/2008 | Chang | |
| D577,580 | S | 9/2008 | Koza | |
| D577,581 | S | 9/2008 | Koza | |
| D595,125 | S | 6/2009 | Doyle | |
| D605,940 | S | 12/2009 | Lin | |
| D648,630 | S | 11/2011 | Doster | |
| D660,702 | S | 5/2012 | Malone | |
| D661,191 | S | 6/2012 | Malone | |
| D692,755 | S | 11/2013 | Curnutt | |
| D758,191 | S | 6/2016 | Tu et al. | |
| D774,393 | S | 12/2016 | Wu | |
| D786,073 | S | 5/2017 | Hutcheson, Jr. | |
| D796,204 | S | 9/2017 | Wax | |
| D796,954 | S | 9/2017 | Lun | |
| D803,057 | S | 11/2017 | Malone | |
| D820,087 | S | 6/2018 | Kelley | |
| D832,057 | S | 10/2018 | Namyst, III | |
| D874,280 | S * | 2/2020 | Malone | D9/456 |
| 2004/0060928 | A1 | 4/2004 | Balla | |
| 2006/0207914 | A1 * | 9/2006 | Cance | B65D 5/509 206/588 |
| 2017/0113862 | A1 | 4/2017 | Malone | |

* cited by examiner

METHOD AND APPARATUS FOR SECURED PACKING OF OBJECTS

CROSS-REFERENCE TO RELATED APPLICATIONS

This application claims priority to, and incorporates by reference for any purpose the entire disclosure of, U.S. Provisional Patent Application No. 62/247,110, filed on Oct. 27, 2015.

BACKGROUND

Field of the Invention

The present application relates generally to secured packaging of objects and more particularly, but not by way of limitation, to secured packaging of objects utilizing one or more hinged packaging blocks.

History of the Related Art

Packaging is a necessary step in many manufacturing and shipping processes. Adequate packaging ensures that articles are not damaged during transport, thereby reducing replacement costs and increasing customer satisfaction. To be effective, packaging must secure an article in three dimensions against movement relative to a container of the article.

SUMMARY

The present application relates generally to secured packaging of objects and more particularly, but not by way of limitation, to secured packaging of objects utilizing one or more hinged packaging blocks. In one aspect, the present invention relates to a packaging block. The packaging block includes a body section having a aperture defined therein. A hinge defines a first portion of the body section and a second portion of the body section. The first portion is rotatably coupled to the second portion via the hinge. A plurality of selectively removable sections are removably coupled to the body section inside the aperture. The aperture receives at least a portion of an article to facilitate securement of the article during packaging and transport.

In another aspect, the present invention relates to a method for packaging an article. The method includes obtaining a packaging block. A width of an aperture defined in a body section of the packaging block is adjusted so as to accommodate at least a portion of the article. A first portion of the body section is rotated relative to a second portion of the body section about a hinge defined in the body section. The portion of the article is received into the aperture. The article and the packaging block are placed into a container.

In another aspect, the present invention relates to a packaging block. The packaging block includes a body section having a rectangular aperture defined therein. The body portion is formed of a shock absorbing material. A hinge defines a first portion of the body section and a second portion of the body section. The first portion is rotatably coupled to the second portion via the hinge. A plurality of selectively removable sections are removably coupled to the body section inside the aperture. The aperture receives a corner region an article to facilitate securement of the article during packaging and transport.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
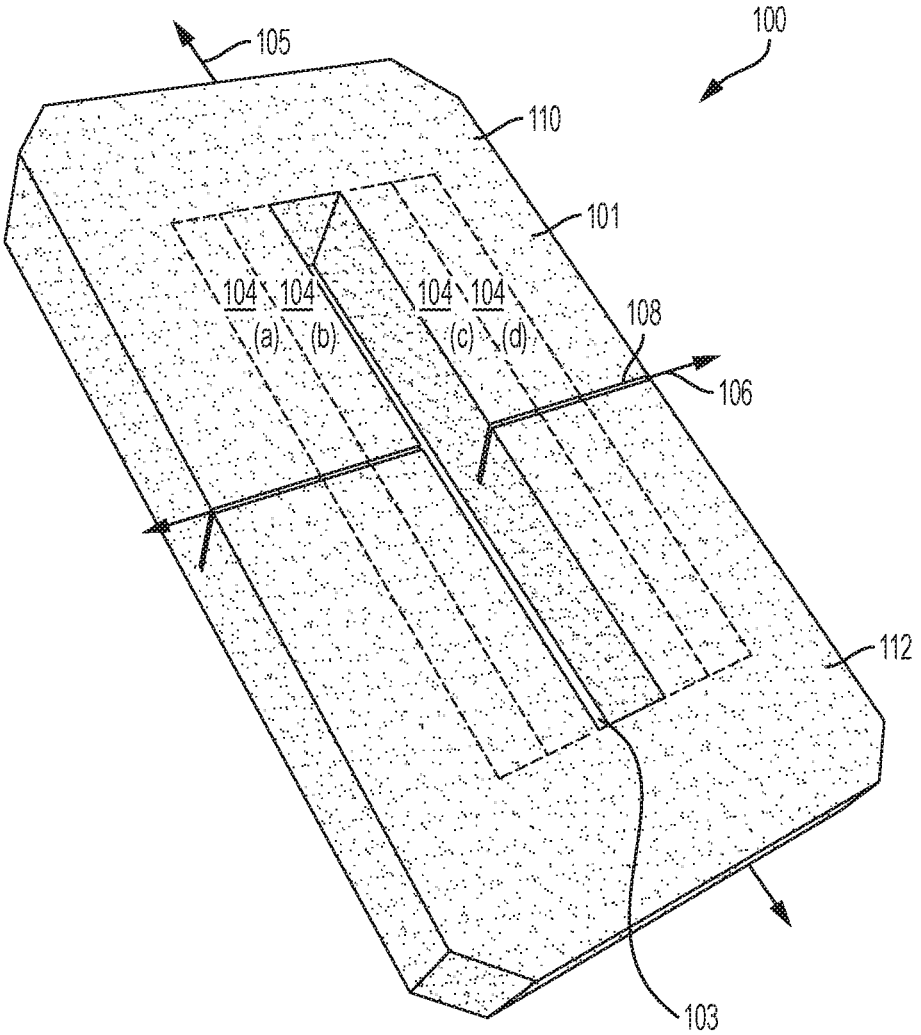
FIG. 1 is a perspective view of a packaging block in an unfolded configuration in accordance with an exemplary embodiment.
Figure 2:
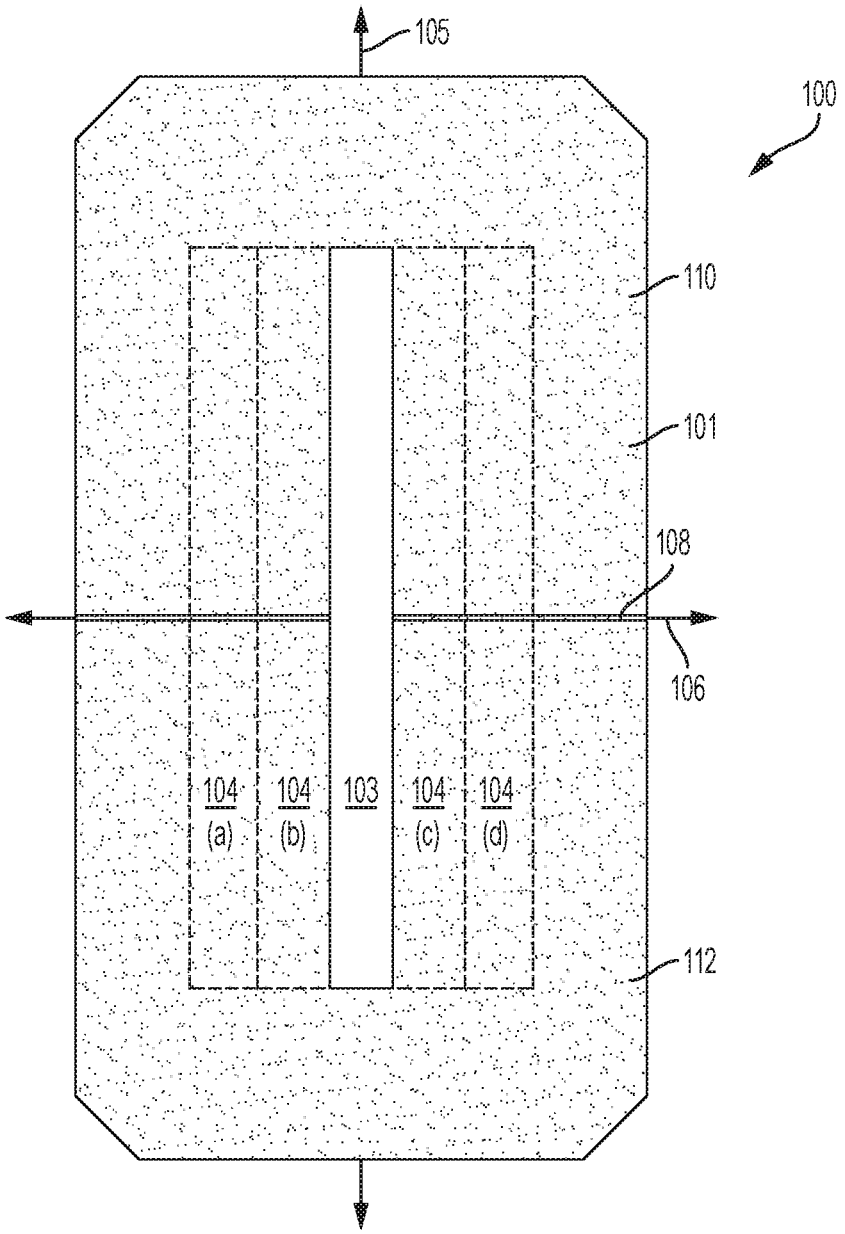
FIG. 2 is a top view of the packaging block of FIG. 1 in accordance with an exemplary embodiment.
Figure 3:
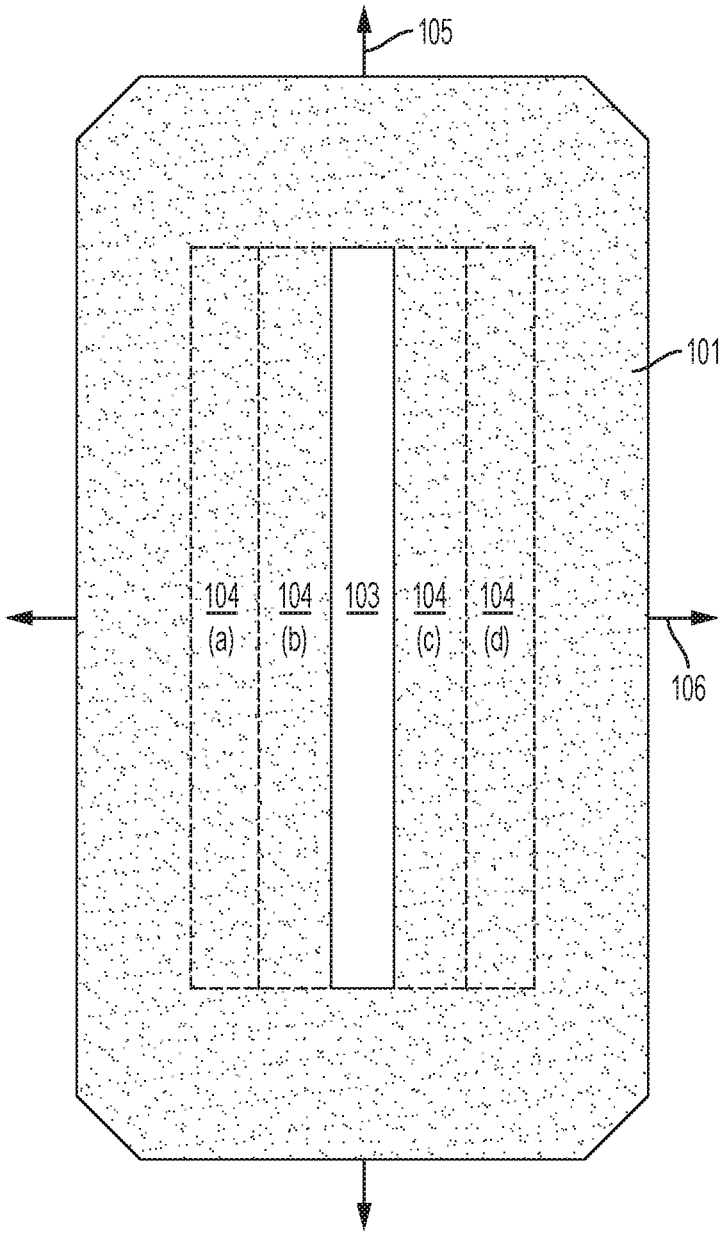
FIG. 3 is a bottom view of the packaging block of FIG. 1 in accordance with an exemplary embodiment.
Figure 4:
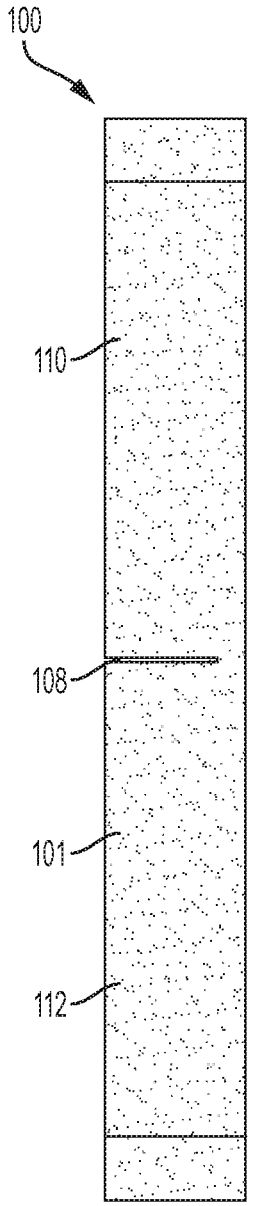
FIG. 4 is a right-side view of the packaging block of FIG. 1 in accordance with an exemplary embodiment.
Figure 6:
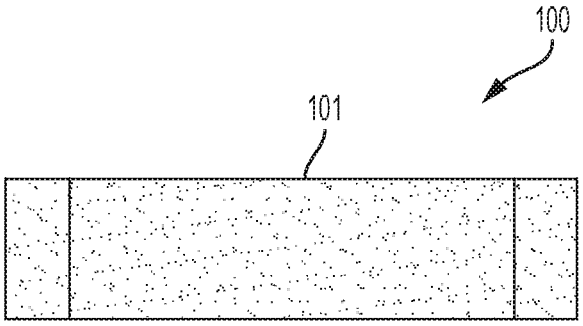
FIG. 6 is a front view of the packaging block of FIG. 1 in accordance with an exemplary embodiment.
Figure 7:
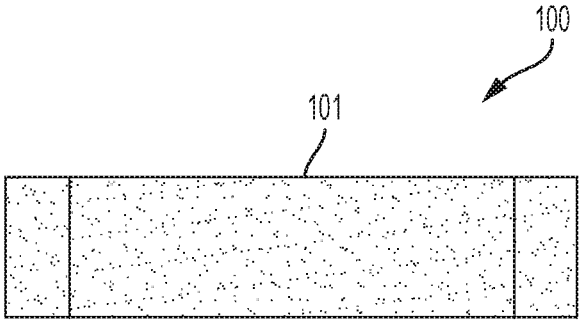
FIG. 7 is a rear view of the packaging block of FIG. 1 in accordance with an exemplary embodiment.
Figure 5:
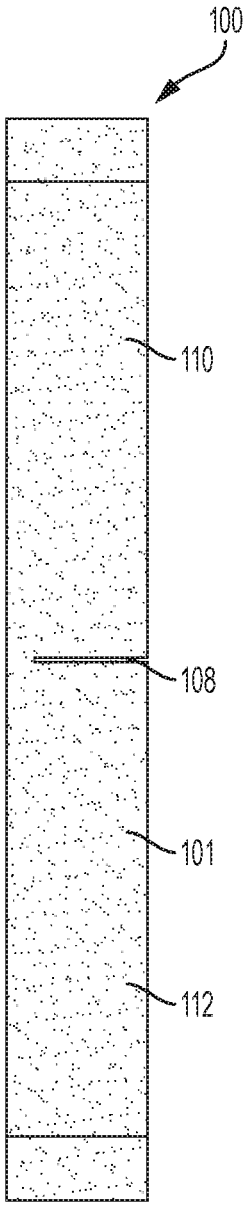
FIG. 5 is a left-side view of the packaging block of FIG. 1 in accordance with an exemplary embodiment.

FIG. 1 is a perspective view of a packaging block 100 in an unfolded configuration. FIGS. 2-7 are various unfolded views of the packaging block 100. Referring to FIGS. 1-7 collectively, the packaging block 100 includes a body section 101 that is formed into a generally rectangular shape having an aperture 103 defined therein. In a typical embodiment, the aperture has a width of approximately 1 inch; however, in other embodiments, different dimensions could be utilized. The body section 101 is, in a typical embodiment, formed of a shock-absorbing material such as, for example, foam. In various embodiments, 1.7# polyethylene recycled foam is utilized; however, in other embodiments, other types of materials could be utilized according to design requirements. In still other embodiments, the body section 101 may be formed of other materials having a variety of densities. In a typical embodiment, the aperture 103 has a generally rectangular shape and is oriented in a direction generally parallel to a long axis 105 of the packaging block 100. A plurality of removable sections 104(*a*)-(*d*) are formed in the body section 101. In a typical embodiment, the removable sections 104(*a*)-(*d*) are defined within the body section 101 via, for example, perforations, scoring, tabs, or other mechanisms as dictated by design requirements. In a typical embodiment, the removable sections 104(*a*)-(*d*) have individual widths of approximately 0.75 inches; however, in other embodiments, different dimensions could be utilized.

In a typical embodiment, the removable sections 104(*a*)-(*d*) are selectively and individually removed from the body section 101 to adjust an overall effective width of the aperture 103. The removable sections 104(*a*)-(*d*) thereby allow the packaging block 100 to accommodate articles of varying thickness. In a typical embodiment, the removable sections 104(*a*)-(*d*) allow the packaging block 100 to selectively accommodate objects of 1 inch width, 1.75 inch width, 2.5 inch width, 3.25 inch width, and 4 inch width. For instance, if all of the removable sections 104(*a*)-(*d*) are left in place, then the packaging block 100 is configured to accommodate an object of 1 inch width. If one of the removable sections 104(*b*) or 104(*c*) are removed, then the packaging block 100 is configured to accommodate an object of 1.75 inch width. If both of the removable sections 104(*b*) and 104(*c*) are removed, then the packaging block 100 is configured to accommodate an object of 2.5 inch width. If the removable sections 104(*a*)-104(*c*) are removed, then the packaging block 100 is configured to accommodate an object of 3 inch width. Alternatively, the removable sections 104(*b*)-104(*d*) could also be removed to configure the packaging block 100 to accommodate an object of 3 inch width. If all of the removable sections 104(*a*)-104(*d*) are removed, then the packaging block 100 is configured to accommodate an object of 4 inch width.

Still referring to FIGS. 2-7, a hinge 108 is defined across the body section 101 in a direction parallel to a short axis 106 of the packaging block 100. In a typical embodiment, the hinge 108 is formed by a score line through the body section and the removable sections 104. In a typical embodiment, the score line forming the hinge 108 has a depth of at least 1 inch. The hinge 108 facilitates folding a first portion 110 of the body section 101 relative to a second portion 112 of the body section 101. In a typical embodiment, the packaging block 100 has dimensions of 6⅜ inches×6 inches×1½ inches when in the folded position; however, in other embodiments, different size variations could be utilized according to design requirements. Although the hinge 108 has been shown and described herein as being oriented parallel to the short axis 106 of the packaging block 100, in various other embodiments, the hinge 108 could be oriented parallel to the long axis 105 of the packaging block 100.

Figure 8:
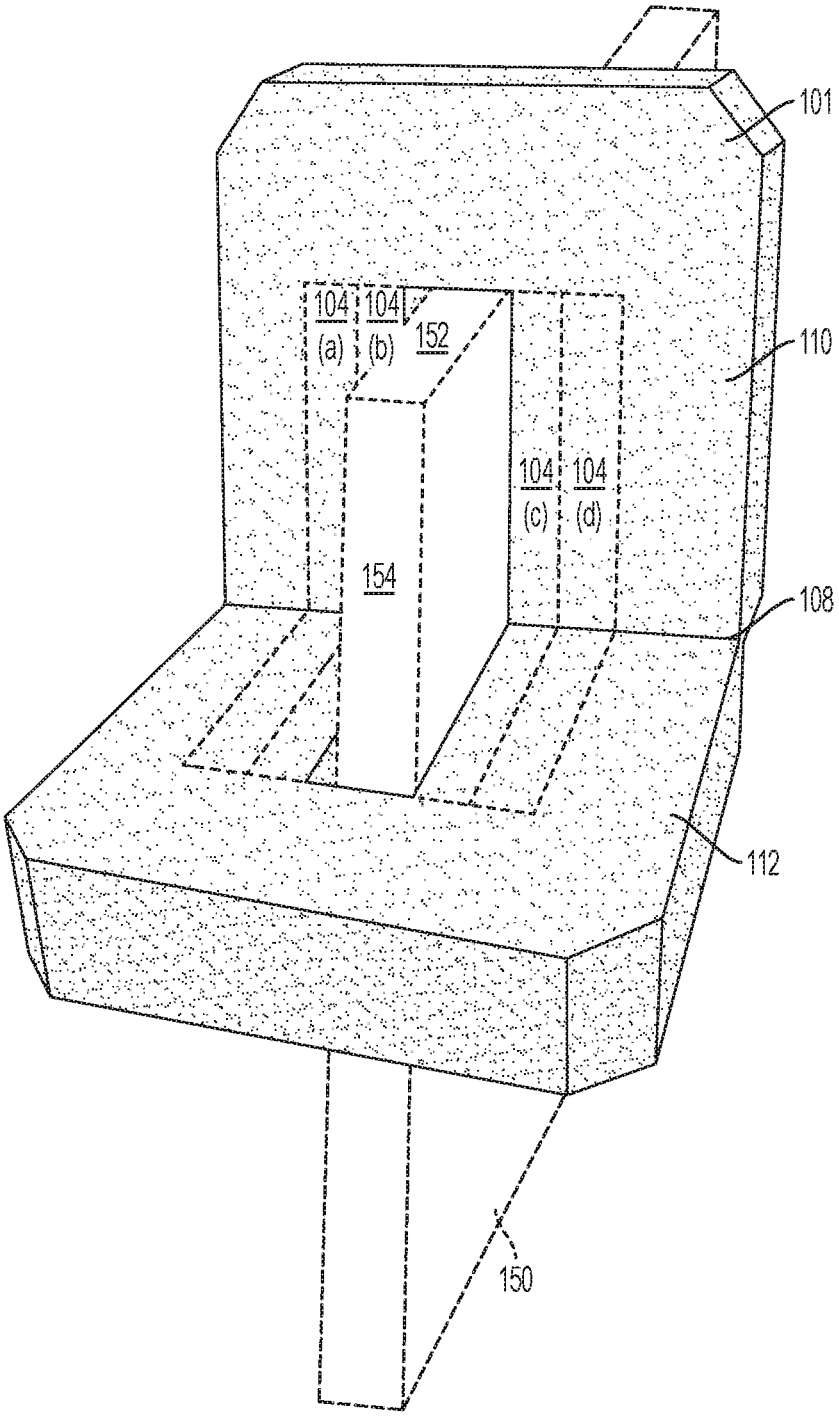
FIG. 8 is a perspective view of the of the packaging block of FIG. 1 in a folded configuration in accordance with an exemplary embodiment.
Figure 9:
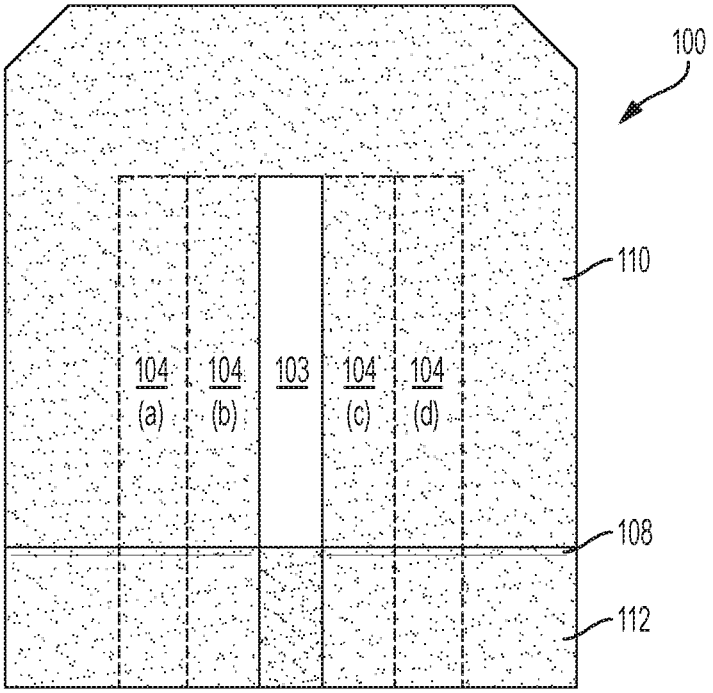
FIG. 9 is a front view of the packaging block of FIG. 8 in accordance with an exemplary embodiment.
Figure 10:
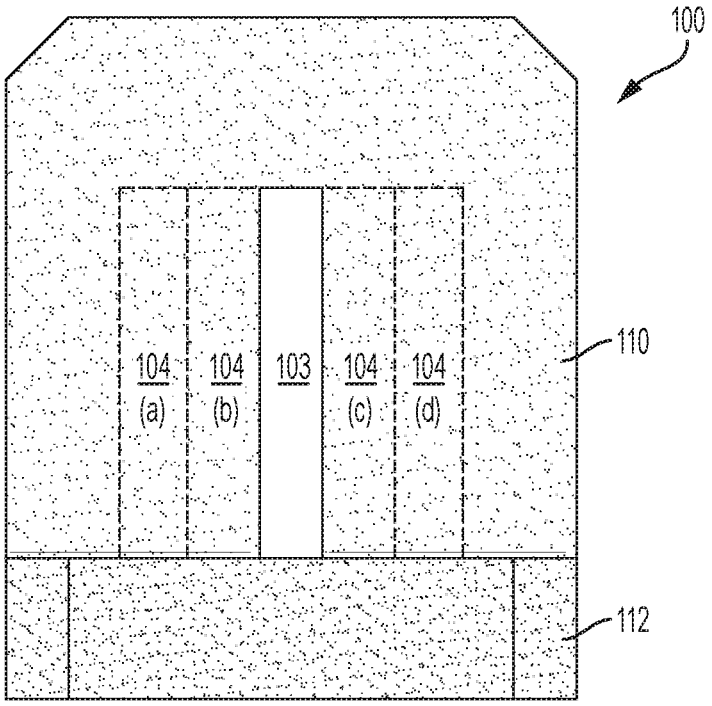
FIG. 10 is a rear view of the packaging block of FIG. 8 in accordance with an exemplary embodiment.
Figure 11:
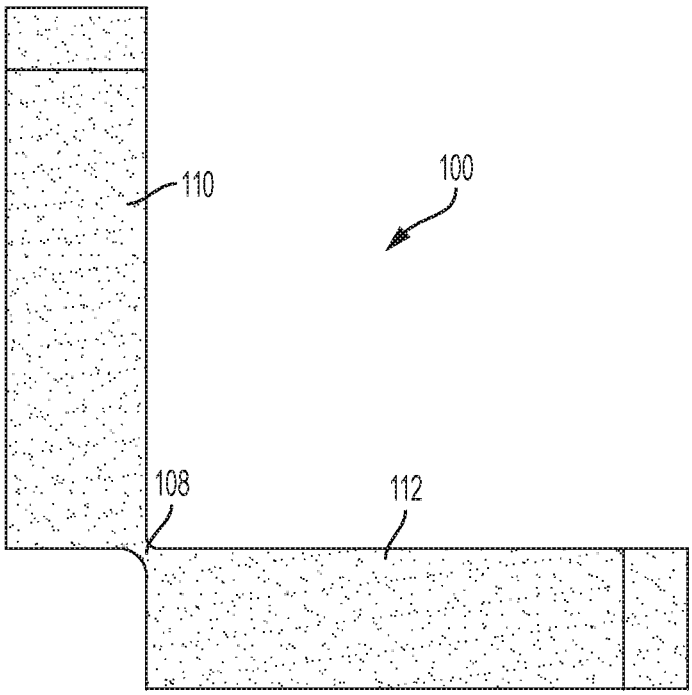
FIG. 11 is a left-side view of the packaging block of FIG. 8 in accordance with an exemplary embodiment.
Figure 12:
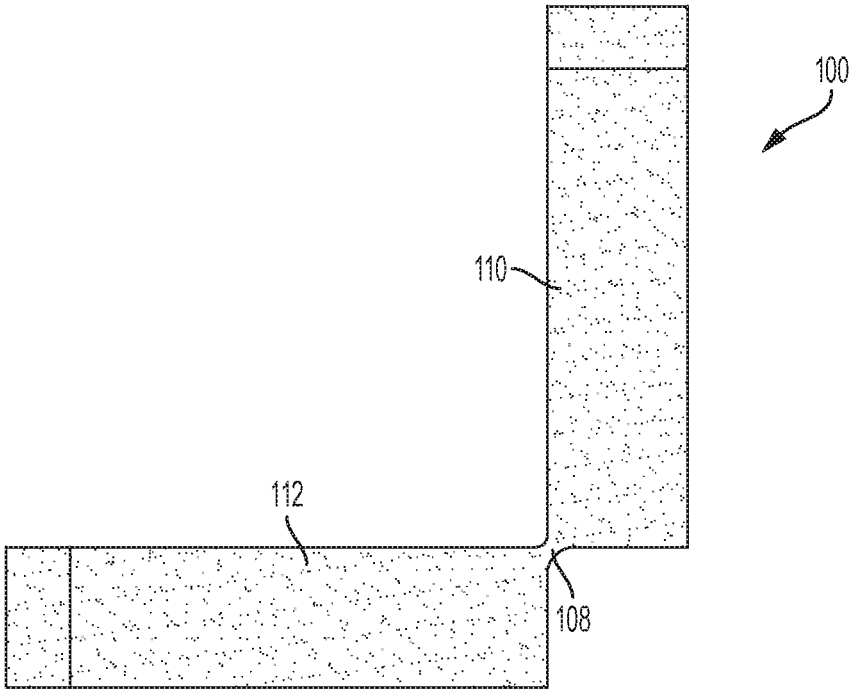
FIG. 12 is a right-side view of the packaging block of FIG. 8 in accordance with an exemplary embodiment.
Figure 13:
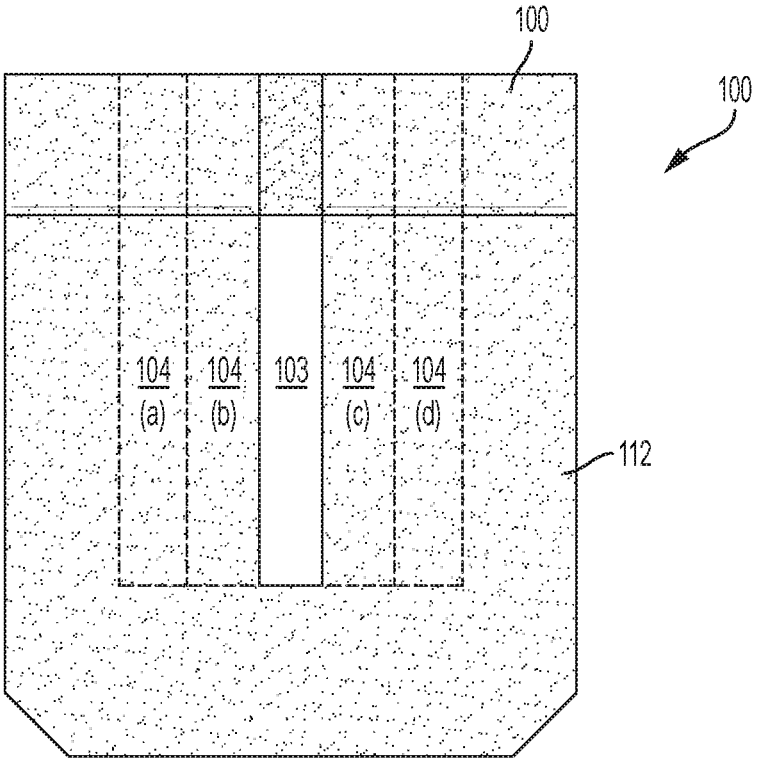
FIG. 13 is a bottom view of the packaging block of FIG. 8 in accordance with an exemplary embodiment.
Figure 14:
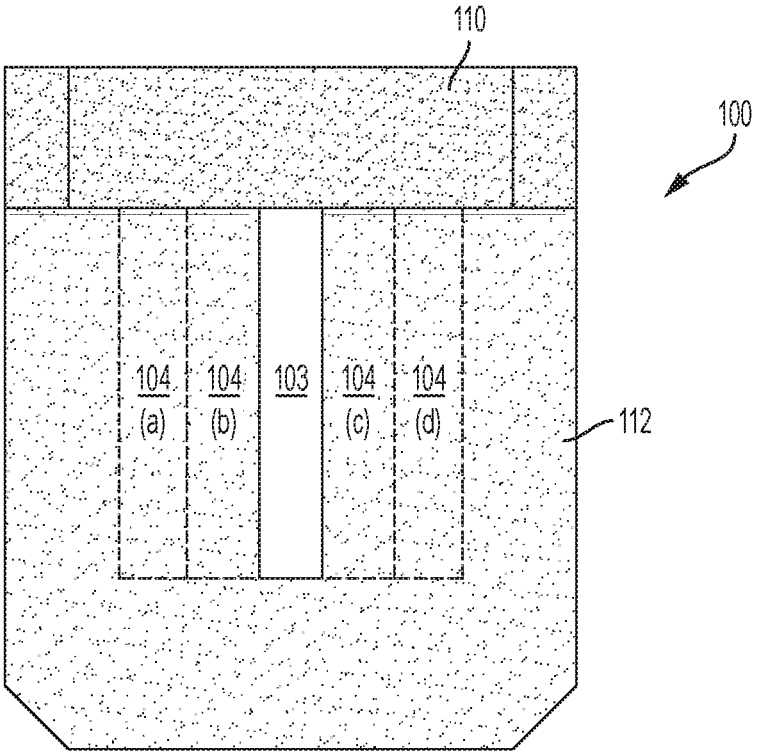
FIG. 14 is a top view of the packaging block of FIG. 8 in accordance with an exemplary embodiment.

FIG. 8 is a perspective view of the of the packaging block 100 in a folded configuration. FIGS. 9-14 are various folded views of the packaging block 100. During operation, the packaging block 100 is placed around a corner region of an article 150 such as, for example, a flat-screen television, a picture frame, or other similar article. The first portion 110 secures a first edge 152 of the article and the second portion 112 secures a second edge 154 of the article 150 that is oriented at an angle relative to the first edge 152.

Figure 15:
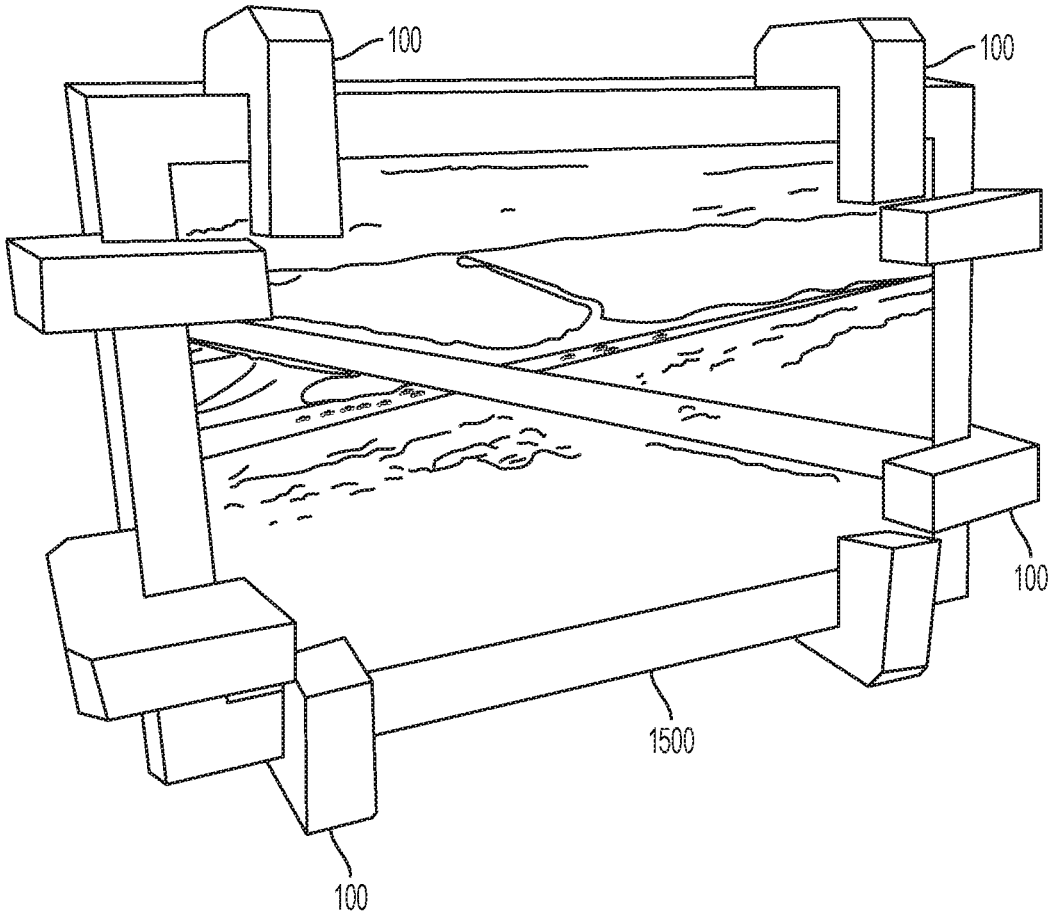
FIG. 15 is a perspective view of an article that is secured using a plurality of the packaging blocks in accordance with an exemplary embodiment.

FIG. 15 is a perspective view of an article 1500 that is secured using a plurality of the packaging blocks 100. A packaging block 100 is positioned at each corner of the article 1500 and thereby secures adjacent edges article 1500 for placement in, for example, a box, a crate, or other container as dictated by design and shipping requirements. When utilized in the manner illustrated in FIG. 15, the packaging block 100 secures the article 1500 in three dimensions during packaging and transport.

Figure 16:
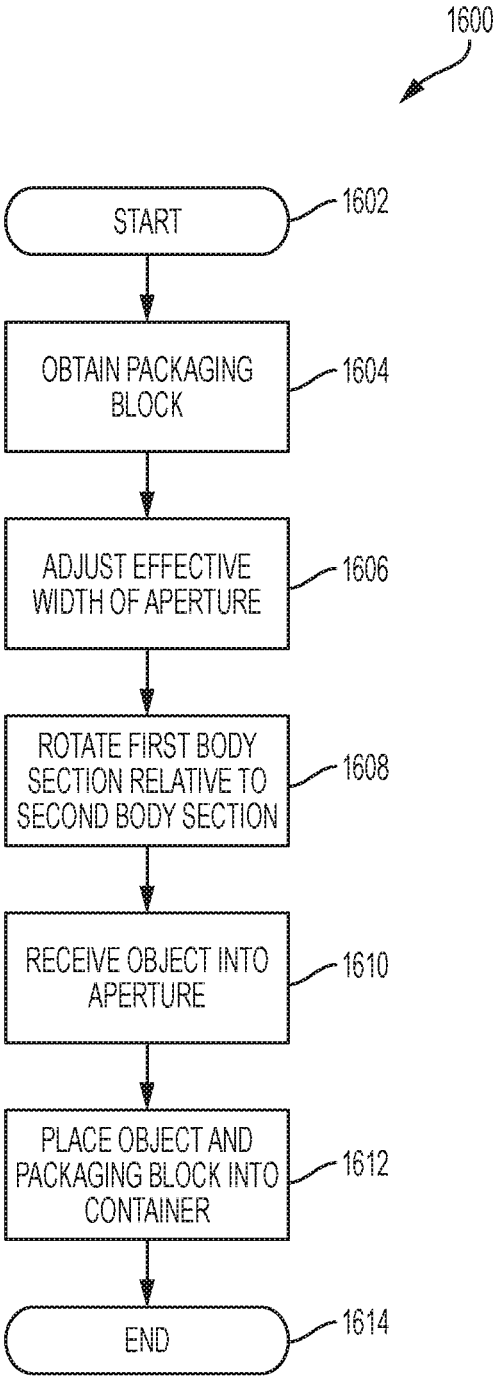
FIG. 16 is a flow diagram illustrating a process for packaging an object utilizing a plurality of packaging blocks in accordance with an exemplary embodiment.

FIG. 16 is a flow diagram illustrating a process 1600 for packaging an object utilizing a plurality of packaging blocks. The process 1600 begins at step 1602. At step 1604, a packaging block is obtained. In a typical embodiment, the packaging block includes a first body section that is coupled to a second body section by a hinge. At step 1606, a width of an aperture defined in the packaging block is adjusted to receive the object. Adjustment of the width of the aperture within packaging block is, in a typical embodiment, accomplished by selectively removing one or more removable sections from the packaging block. At step 1608, the first body section is rotated relative to the second body section about the hinge. At step 1610, at least a portion of the object is received into the aperture. At step 1612, the object, with the packaging block, is placed into a container. The process ends at step 1614.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A packaging block comprising:

a body section having an aperture defined therein;

a hinge arranged perpendicular to a long axis of the body section and defining a first portion of the body section and a second portion of the body section, the first portion being rotatably coupled to the second portion via the hinge;

a plurality of selectively removable sections located within the aperture and coupled to the body section, each removable section of the plurality of removable sections being hinged parallel with the hinge, wherein the removable sections define a space within the aperture, wherein removal of select sections of the plurality of removable sections adjusts a width of the space from approximately 1 inch to approximately 4 inches; and sections removably coupled to the body section, each removable section of the plurality of removable sections being hinged parallel with the hinge, wherein removal of select sections of the plurality of removable sections adjusts the width of the aperture from approximately 1 inch to approximately 4 inches; and wherein the aperture receives at least a portion of an article to facilitate securement of the article during packaging and transport.

2. The packaging block of claim 1, wherein a length of the aperture is oriented generally parallel to a long axis of the body section.

3. The packaging block of claim 1, wherein the hinge is oriented generally parallel to a short axis of the body section.

4. The packaging block of claim 1, wherein selective removal of the plurality of selectively removable sections facilitates receipt of articles of varying thickness into the aperture.

5. The packaging block of claim 1, wherein the body section comprises a rectangular shape.

6. The packaging block of claim 1, wherein the body section comprises a shock-absorbing material.

7. The packaging block of claim 1, wherein the aperture receives a corner region of the article.

8. The packaging block of claim 1, wherein the body section prevents movement of the article relative to a container.

9. The packaging block of claim 8, wherein the body section secures the article in three dimensions.

10. A packaging block comprising:

a body section having a rectangular aperture defined therein, the body section being formed of a shock absorbing material;

a hinge arranged perpendicular to a long axis of the body section and defining a first portion of the body section and a second portion of the body section, the first portion being rotatably coupled to the second portion via the hinge;

a plurality of selectively removable sections located within the aperture and coupled to the body section, each removable section of the plurality of removable sections being hinged parallel with the hinge, wherein the removable sections define a space within the aperture, wherein removal of select sections of the plurality of removable sections adjusts a width of the space from approximately 1 inch to approximately 4 inches; and sections removably coupled to the body section and formed of the shock absorbing material, each removable section of the plurality of removable sections being hinged parallel with the hinge, wherein removal of select sections of the plurality of removable sections adjusts the width of the aperture from approximately 1 inch to approximately 4 inches; and wherein the aperture receives a corner region an article having a width of approximately 1 inch to approximately 4 inches to facilitate securement of the article during packaging and transport.

11. The packaging block of claim 10, wherein the aperture is oriented generally parallel to a long axis of the body section.

12. The packaging block of claim 10, wherein the hinge is oriented generally parallel to a short axis of the body section.

13. The packaging block of claim 10, wherein selective removal of the plurality of selectively removable sections facilitates receipt of articles of varying thickness into the aperture.

* * * * *